United States Patent [19]

Koester et al.

[11] Patent Number: 4,814,070

[45] Date of Patent: Mar. 21, 1989

[54] ALKYL SULFOSUCCINATES BASED ON ALKOXYLATED FATTY ALCOHOLS AS COLLECTORS FOR NON-SULFIDIC ORES

[75] Inventors: Rita Koester; Wolfgang von Rybinski, both of Duesseldorf; Uwe Ploog, Haan, all of Fed. Rep. of Germany

[73] Assignee: Henkel Kommanditgesellschaft auf Aktien, Duesseldorf, Fed. Rep. of Germany

[21] Appl. No.: 128,135

[22] Filed: Dec. 3, 1987

[30] Foreign Application Priority Data

Dec. 8, 1986 [DE] Fed. Rep. of Germany ..... 3641870

[51] Int. Cl.[4] ..... B03D 1/02

[52] U.S. Cl. ..... 209/166; 252/61

[58] Field of Search ..... 209/166, 167; 252/61; 560/151

[56] References Cited

U.S. PATENT DOCUMENTS

| | | | |
|---|---|---|---|
| 4,039,562 | 8/1977 | Bloch | 560/151 |
| 4,081,363 | 3/1978 | Grayson | 209/166 |
| 4,110,207 | 8/1978 | Wang | 209/166 |
| 4,138,350 | 2/1979 | Wang et al. | 209/166 |
| 4,192,739 | 3/1980 | Wang | 209/166 |
| 4,207,178 | 6/1980 | Wang | 209/166 |
| 4,309,282 | 1/1982 | Smith | 209/166 |
| 4,430,238 | 2/1984 | Hellston | 209/166 |

OTHER PUBLICATIONS

W. von Rybinski, et al., Adsorption of Surfactant Mixtures During Flotation, 1985, pp. 632–639.

Doren et al., Developments in Mineral Processing, 1979, pp. 86–109.

*Primary Examiner*—David L. Lacey

*Assistant Examiner*—Thomas M. Lithgow

*Attorney, Agent, or Firm*—Ernest G. Szoke; Wayne C. Jaeschke; Henry E. Millson, Jr.

[57] ABSTRACT

Alkyl sulfosuccinates based on propoxylated and propoxylated and ethoxylated fatty alcohols as flotation collectors for non-sulfidic ores and to a process for the separation of non-sulfidic ores by flotation in which the alkyl sulfosuccinates used contain one or two identical or different, straight-chain and/or branched-chain, saturated or unsaturated alkyl radicals based on propoxylated or propoxylated and ethoxylated $C_8$–$C_{22}$ fatty alcohols.

12 Claims, No Drawings

ALKYL SULFOSUCCINATES BASED ON ALKOXYLATED FATTY ALCOHOLS AS COLLECTORS FOR NON-SULFIDIC ORES

BACKGROUND OF THE INVENTION

1. Field of the Invention

This invention relates to the use of alkyl sulfosuccinates based on alkoxylated fatty alcohols as collectors in the flotation of non-sulfidic ores.

2. Statement of Related Art

Flotation is a separation technique commonly used in the dressing of mineral crude ores for separating valuable minerals from the gangue. Non-sulfidic minerals in the context of the present invention are, for example, apatite, fluorite, scheelite and other salt-like minerals, cassiterite and other metal oxides, for example titanium and zirconium oxides, and also certain silicates and aluminosilicates. In general, the ore is first subjected to preliminary size-reduction, dry-ground or preferably wet-ground, and suspended in water. Collectors are then normally added to the ores, often in conjunction with frothers and, optionally, other auxiliary reagents, such as regulators, depressors (deactivators) and/or activators, in order to facilitate separation of the valuable minerals from the gangue constituents of the ore. After a certain contact time, air is blown into the suspension (flotation). A froth is thus produced at the surface of the suspension. The collector hydrophobicizes the surface of the minerals so that they adhere to the gas bubbles formed during the activation step, and are then stripped off in the form of a mineral-containing froth and further processed. The object of flotation is to recover the valuable mineral in as high a yield as possible while, at the same time, obtaining a high degree of enrichment.

Anionic and cationic surfactants are predominantly used as collectors in the flotation of non-sulfidic ores. These collectors are intended to be selectively absorbed to the surfaces of the valuable minerals in order to obtain a high enrichment level in the flotation concentrate. In addition, the collectors are intended to act to form a buoyant, but not too stable flotation froth.

Alkyl sulfosuccinates are frequently used in the flotation of non-sulfidic ores (W. v. Rybinski, M. J. Schwuger, "Aufbereitungstechnik", 26 (1985), page 632 and A. Doren, loc. cit.). In many cases, good flotation results can be obtained with collectors such as these. In some cases, however, known alkyl sulfosuccinates lead to undesirably intensive frothing.

U.S. Pat. No. 4,138,350 describes alkyl sulfosuccinates with an ethoxylated alkyl chain as flotation collectors. However, it has been found that the alkyl sulfosuccinates based on ethoxylated alcohols which are described in U.S. Pat. No. 4,138,350 do not always have favorable frothing properties for flotation or a good collector effect.

DESCRIPTION OF THE INVENTION

Other than in the operating examples or where otherwise indicated, all numbers expressing quantities of ingredients or reaction conditions used herein are to be understood as modified in all instances by the term "about".

An object of the present invention is to provide alkyl sulfosuccinates based on certain alkoxylated fatty alcohols which show improved collector properties in comparison with known alkyl sulfosuccinates and which, in particular, avoid undesirably intensive frothing.

Accordingly, the present invention relates to alkyl sulfosuccinates based on propoxylated alcohols as collectors in the flotation of non-sulfidic ores. According to the invention, alkyl sulfosuccinates having a propoxylated chain of the type derived from $C_8$–$C_{22}$ fatty alcohols, i.e. those containing one or two, identical or different, straight-chain and/or branched-chain, saturated or unsaturated alkyl radicals based on propoxylated $C_8$–$C_{22}$ fatty alcohols, or ethoxylated and propoxylated $C_8$–$C_{22}$ fatty alcohols, are used as flotation collectors.

The alkyl radicals of the propoxylated fatty alcohols preferably contain from 12 to 18 carbon atoms and may be linear or branched.

The fatty alcohol component of the alkyl sulfosuccinates can consist of linear or branched, saturated or unsaturated compounds of this category containing from 8 to 22 carbon atoms, for example n-octanol, n-decanol, n-dodecanol, n-tetradecanol, n-hexadecanol, n-octadecanol, n-eicosanol, n-docosanol, n-hexadecenol, isotridecanol, iso-octadecanol, and n-octadecenol.

The above fatty alcohols can individually form the basis of the alkyl sulfosuccinates. In general, however, products based on fatty alcohol mixtures are used; these fatty alcohol mixtures emanating from the fatty acid component of fats and oils of vegetable or animal origin. It is known that fatty alcohol mixtures such as these can be obtained from native fats and oils, inter alia, by transesterification of the triglycerides with methanol and subsequent catalytic hydrogenation of the fatty acid methyl ester. In this case, both the fatty alcohol mixtures accumulating in the production process and also suitable fractions having a limited chain length spectrum can be used as the basis for the production of the alkyl sulfosuccinates. Besides the fatty alcohol mixtures obtained from natural fats and oils, synthetic fatty alcohol mixtures, for example the known Ziegler and oxo fatty alcohols, are suitable as starting materials for the production of the alkyl sulfosuccinates.

The fatty alcohol radicals of the alkyl sulfosuccinates each contain at least one propylene oxide group. Alkyl sulfosuccinates of which the fatty alcohol radicals contain from 1 to 6 propylene oxide groups are preferably used.

Adducts of m moles ethylene oxide and n moles propylene oxide (m and n are both numbers of from 1 to 15, the sum of m and n is from 2 to 25 and the ratio of m to n is from 1:5 to 2:1) with fatty alcohols can also be used for the alkyl sulfosuccinates.

For the flotation of non-sulfidic ores, the alkyl suflosuccinates according to the invention are added to the crude ore in a quantity of from 50 to 2000 g/t.

The present invention also relates to a process for the separation of non-sulfidic ores from the gangue, in which crushed ore is mixed with water to form a suspension, air is introduced into the suspension in the presence of the above described alkyl sulfosuccinates based on alkoxylated fatty alcohols and the froth formed is separated off together with the mineral present therein.

In the process of the invention for the separation of non-sulfidic ores from the gangue, the alkyl sulfosuccinates based on propoxylated fatty alcohols as stated above are preferably used in a quantity of from 50 to 2000 g/t crude ore.

The alkyl sulfosuccinates of the invention are particularly suitable for use in the flotation of scheelite, apatite, or iron ore.

The alkyl sulfosuccinates based on propoxylated fatty alcohols can be present as full esters or as semiesters of sulfosuccinic acid. In addition, the sulfosuccinic acid full and semiesters of the invention are used not in the form of the free sulfonic acid, but as alkali metal and/or ammonium salts, sodium and ammonium salts and, in particular, mixtures of sodium and ammonium salts.

The advantage of the alkyl sulfosuccinates based on suitable propoxylated fatty alcohols over the known alkyl sulfosuccinates is that, where the alkyl sulfosuccinates according to the invention are used, improved collector properties are obtained in the flotation of the above-mentioned crude ores. The more favorable frothing properties and the improved collector effect of the compounds according to the invention are illustrated in the following Examples.

The tests were carried out under laboratory conditions, in some cases with increased collector concentrations considerably higher than necessary in practice. Accordingly, the potential applications and in-use conditions are not limited to the separation exercises and test conditions described in the Examples. All percentages are percentages by weight, unless otherwise indicated. The quantities indicated for reagents are all based on active substance.

The following examples illustrate but do not limit the invention.

EXAMPLES

Examples 1 to 3

Comparison Examples 1 and 2

The frothing of alkyl sulfosuccinates in the form of their $Na/NH_4$ salts was determined under standard conditions by the perforated-disc froth beating process. The results of the tests are shown in Table 1. It can be seen that the sulfosuccinates according to the invention based on propoxylated fatty alcohol/ethylene oxide/-propylene oxide adducts generate less froth than the other sulfosuccinates. This is an advantage for many flotation process.

TABLE 1

Determination of frothing power
Perforated-disc froth-beating process according to DIN 53 905
Conditions: 1 g AS/l, in water of 8° Gh, 40° C.
EO = ethylene oxide; PO = propylene oxide;
AS = active substance

| Example | Composition | ml Froth after 1 min. | ml Froth after 20 mins. |
|---|---|---|---|
| Comp. Ex. 1 | alkyl sulfosuccinate based on $C_{16}$–$C_{18}$ oleyl-cetyl alcohol with 2 EO, $Na/NH_4$ salt | 300 | 240 |
| Comp. Ex. 2 | alkyl sulfosuccinate based on $C_{12}$–$C_{18}$ lauryl alcohol with 5 EO, $Na/NH_4$ salt | 500 | 360 |
| Ex. 1 | alkyl sulfosuccinate based on $C_{16}$–$C_{18}$ oleyl-cetyl alcohol with 1 PO, $Na/NH_4$ salt | 190 | 150 |
| Ex. 2 | alkyl sulfosuccinate based on $C_{16}$–$C_{18}$ oleyl-cetyl alcohol with 2 PO, $Na/NH_4$ salt | 210 | 140 |
| Ex. 3 | alkyl sulfosuccinate based on a mixture of $C_{16}$–$C_{18}$ oleyl-cetyl alcohol with 2 EO and with 2 PO, $Na/NH_4$ salt | 90 | 50 |

Example 4

Comparison Example 3

The material to be floated was a scheelite ore from Austria which had the following chemical composition, based on its principal constituents:

$WO_3$ 0.3%
CaO 8.8%
$SiO_2$ 55.8%

The ore sample had the following particle size distribution:

28% up to 25 μm
43% 25–100 μm
29% 100–200 μm

An alkyl sulfosuccinate $Na/NH_4$ salt based on $C_{16}$–$C_{18}$ oleyl-cetyl alcohol with 2 PO (Example 4) was used as the collector according to the invention.

The comparison collector was a tallow alkyl sulfosuccinate, $Na/NH_4$ salt, based on $C_{16}$–$C_{18}$ oleyl-cetyl alcohol with 2 EO (Comparison Example 3).

The flotation tests were carried out in a 1 liter flotation cell using a Humbold-Wedag laboratory flotation machine of the type manufactured by KHD Industrieanlagen AG, Humbold-Wedag, Cologne (see Seifen-Fette-Wachse 105 (1979), page 248). Deionized water was used to prepare the pulp. The pulp density was 400 g/l. Waterglass was used as depressor in a quantity of 2000 g/t. The conditioning time of the depressor was 10 minutes at a stirring speed of 2000 l/min. Flotation was carried out at the pH value of approx. 9.5 obtained by addition of the waterglass. The collector dosage is shown in Table 2 below. The conditioning time of the collector was 3 minutes.

As can be seen from Table 2, a distinctly higher recovery of $WO_3$ and a consideragbly better enrichment in the concentrate are obtained with the collector of Example 4.

TABLE 2

Flotation of an Austrian scheelite ore in a KHD laboratory flotation cell, pulp density 400 g/l

| Example | Dosage g/t* | Recovery total | $WO_3$ | Concentrate content $WO_3$ | CaO | $SiO_2$ | $Al_2O_3$ | $Fe_2O_3$ | Enrichment factor $WO_3$ |
|---|---|---|---|---|---|---|---|---|---|
| Comp. Ex. 3 | 300 | 1.0 | 18 | 6.0 | 17.6 | 30.1 | 9.7 | 9.0 | 18 |
| | 50 | 4.3 | 38 | 2.9 | 6.7 | 36.2 | 12.9 | 11.8 | 9 |
| | Σ350 | 5.3 | 56 | 3.5 | 8.7 | 35.1 | 12.3 | 11.3 | 11 |
| Ex. 4 | 300 | 2.4 | 75 | 10.2 | 22.4 | 22.4 | 6.8 | 7.9 | 31 |
| | 100 | 1.2 | 7 | 1.9 | 14.6 | 33.8 | 10.8 | 11.1 | 6 |

TABLE 2-continued

| Flotation of an Austrian scheelite ore in a KHD laboratory flotation cell, pulp density 400 g/l | | | | | | | | | |
|---|---|---|---|---|---|---|---|---|---|
| | Dosage | Recovery | | Concentrate content | | | | | Enrichment factor |
| Example | g/t* | total | $WO_3$ | $WO_3$ | CaO | $SiO_2$ | $Al_2O_3$ | $Fe_2O_3$ | $WO_3$ |
| | Σ400 | 3.6 | 82 | 7.4 | 19.8 | 26.2 | 8.1 | 9.0 | 23 |

*The dosage figures are based on active substance.

Examples 5 and 6

Comparison Examples 4 and 5

The material to be floated was a Brazilian apatite or which, besides silicates, also contained iron oxides as gangue minerals. The ore had the following composition, based on its principal constituents:

approx.
21% $P_2O_5$
12% $Fe_2O$
26% $SiO_2$

The ore sample had the following particle size distribution:

21% up to 40 μm
38% 40–100 μm
35% 100–250 μm
6% over 250 μm

An alkyl sulfosuccinate, Na/$NH_4$ salt, based on $C_{16}$–$C_{18}$ oleyl cetyl alcohol with 2 PO in combination with tall oil fatty acid in various mixing ratios was used as the collector according to the invention. An alkyl sulfosuccinate, Na/$NH_4$ salt, based on $C_{16}$–$C_{18}$ oleyl-cetyl alcohol with 2 PO in a ratio of 1:1 to the tall oil fatty acid was used in Example 5, while the collector mixture of Example 6 coresponded to a ratio of 2:1 of the above-mentioned alkyl sulfosuccinate, Na/$NH_4$ salt, based on oleyl-cetyl alcohol, to tall oil fatty acid.

A tallow alcohol sulfosuccinate, Na/$NH_4$ salt, again in the form of corresponding mixtures with tall oil fatty acid (1:1), was used as further comparison collector based on $C_{16}$–$C_{18}$ oleyl-cetyl alcohol with 2 EO (Comparison Example 5). The flotation tests were carried out at room temperature in a laboratory flotation cell (Denver Equipment model D-1, capacity 1 liter). Tapwater having a hardness of 16° Gh was used to prepare the pulp. The pulp density was 500 g/l; the pH value was adjusted to 10.5 with sodium hydroxide before addition of the collector. After rougher flotation (for 6 minutes), the concentrate was purified twice. Flotation was carried out at 1200 l/minute in every stage. Starch (600 g/t) was used as depressor.

According to the results shown in Table 3, the collector dosage can be considerably reduced without ay reduction in recovery or selectivity by replacing the tallow alkyl sulfosuccinate (Comparison Example 5) with the compound of Examples 5 and 6 according to the invention. This effect was observed both with a 1:1 mixture and with a 2:1 mixture of the sulfosuccinates with fatty acid.

TABLE 3

| Example | Collector g/t[1] | Flotation stage | Content (%) $P_2O_5$ | $Fe_2O_3$ | $SiO_2$ | Recovery (%) $P_2O_5$ |
|---|---|---|---|---|---|---|
| Example 5 | 320 | RT[2] | 5.4 | 20.6 | 52.2 | 9 |
| | | CT[2] | 19.1 | 16.4 | 26.0 | 17 |
| | | conc.[2] | 38.1 | 2.4 | 3.1 | 74 |
| | | batch | 22.2 | 11.9 | 25.8 | 100 |
| Example 6 | 320 | RT | 5.4 | 20.6 | 52.2 | 9 |
| | | CT | 19.1 | 16.4 | 26.0 | 17 |
| | | conc. | 38.1 | 2.4 | 3.1 | 74 |

TABLE 3-continued

| Example | Collector g/t[1] | Flotation stage | Content (%) $P_2O_5$ | $Fe_2O_3$ | $SiO_2$ | Recovery (%) $P_2O_5$ |
|---|---|---|---|---|---|---|
| | | batch | 22.2 | 11.9 | 25.8 | 100 |
| Comp. Ex. 4 | 440 | RT | 7.0 | 16.1 | 58.5 | 10 |
| | | CT | 17.3 | 15.9 | 28.1 | 20 |
| | | conc. | 33.7 | 6.3 | 4.4 | 70 |
| | | batch | 21.6 | 11.6 | 26.4 | 100 |
| Comp. Ex. 5 | 450 | RT | 5.2 | 16.1 | 59.2 | 6 |
| | | CT | 15.8 | 18.3 | 29.7 | 21 |
| | | conc. | 34.7 | 5.4 | 3.3 | 73 |
| | | batch | 21.5 | 11.9 | 25.7 | 100 |

[1]The collector dosage figures are based on active substance
[2]RT = tailings of rougher flotation; CT = tailings of purifying flotation (total); conc. = concentrate

Examples 7 and 8

Comparison Example 6

The material to be floated was the waste from an iron ore dressing plant, of which the composition was as follows (principal constituents):

approx.
12% $P_2O_5$
36% $SiO_2$
14% $Fe_2O_3$
15% CaO

The very coarse flotation batch had the following particle size distribution:

5% up to 25 μm
15% 25–100 μm
70% 200–500 μm
9% 500–1000 μm
1% over 1000 μm

An alkyl sulfosuccinate, Na/$NH_4$ salt, based on $C_{16}$–$C_{18}$ oleyl-cetyl alcohol with 1 PO was used for Example 7.

An alkyl sulfosuccinate, Na/$NH_4$ salt, based on $C_{16}$–$C_{18}$ oleyl-cetyl alcohol with 2 EO and 1 PO was used as collector for Example 8.

An alkyl sulfosuccinate based on $C_{16}$–$C_{18}$ oleyl-cetyl alcohol with 2 EO, which was also present as the Na/$NH_4$ salt, was used for Comparison Example 6.

The flotation tests were carried out in a laboratory cell of the type described in Example 5. The pH value was adjusted with sodium hydroxide to 9.5; no depressors were used. The rougher concentrate was purified once.

The flotation results (Table 4) show that the compounds according to the invention, including those based on tallow alcohol-EO/PO adducts, afford advantages over known alkyl sulfosuccinates. The apatite recovery increases despite reduced collector dosage.

TABLE 4

| Example | g/t[1] | Flotation stage | Content (%) $P_2O_5$ | $SiO_2$ | $Fe_2O_3$ | CaO | Recovery (%) $P_2O_5$ |
|---|---|---|---|---|---|---|---|
| Comp. Ex. 6 | 288 | RT[2] | 1.8 | 49.7 | 15.4 | 7.9 | 11 |
| | | CT[2] | 22.6 | 22.1 | 8.0 | 32.4 | 11 |

TABLE 4-continued

| Example | g/t[1] | Flotation stage | Content (%) $P_2O_5$ | $SiO_2$ | $Fe_2O_3$ | CaO | Recovery (%) $P_2O_5$ |
|---|---|---|---|---|---|---|---|
| | | conc.[2] | 41.2 | 0.9 | 0.6 | 51.5 | 78 |
| | | batch | 11.8 | 37.2 | 11.7 | 19.0 | 100 |
| Example 7 | 244 | RT | 1.4 | 49.6 | 15.7 | 7.2 | 9 |
| | | CT | 11.3 | 34.0 | 15.2 | 20.2 | 3 |
| | | conc. | 40.9 | 0.9 | 0.7 | 53.2 | 88 |
| | | batch | 11.8 | 36.7 | 11.9 | 19.3 | 100 |
| Example 8 | 247 | RT | 0.9 | 49.7 | 14.7 | 6.3 | 5 |
| | | CT | 4.4 | 39.6 | 20.9 | 11.4 | 1 |
| | | conc. | 39.6 | 2.2 | 1.5 | 51.7 | 94 |
| | | batch | 11.8 | 36.1 | 11.2 | 19.1 | 100 |

For [1] and [2], see Table 3.

We claim:

1. In a process for the separation of non-sulfidic mineral ores by froth flotation, in which crude crushed non-sulfide mineral ore is mixed with water to form a suspension, air is introduced into the suspension, which suspension contains a collector, and the froth formed is separated off together with the mineral present therein, the improvement comprising using as the collector a flotation-effective quantity of at least one sulfosuccinate which contains as a monoester or diester group, identical or different, straight-chain or branched-chain, saturated or unsaturated, propoxylated $C_8$–$C_{22}$ alkyl group or propoxylated and ethoxylated $C_8$–$C_{22}$ alkyl group.

2. The process of claim 1 wherein the ore is scheelite ore, apatite ore, or iron ore.

3. The process of claim 1 in which the $C_8$–$C_{22}$ alkyl group or groups of the sulfosuccinate contain from 12 to 18 carbon atoms.

4. The process of claim 1 wherein the $C_8$–$C_{22}$ alkyl group or groups of the sulfosuccinate are propoxylated with from 1 to 6 propylene oxide groups.

5. The process of claim 3 wherein the $C_{12}$–$C_{18}$ alkyl group or groups of the sulfosuccinate are propoxylated with from 1 to 6 propylene oxide groups.

6. The process of claim 1 wherein the $C_8$–$C_{22}$ alkyl group or groups of the sulfosuccinate are saturated.

7. The process of claim 1 wherein the $C_8$–$C_{22}$ alkyl group or groups of the sulfosuccinate are propoxylated and ethoxylated.

8. The process of claim 7 wherein the $C_8$–$C_{22}$ alkyl group or groups of the sulfosuccinate are adducts of m moles of ethylene oxide and n moles of propylene oxide wherein m and n are both numbers of from 1 to 15, the sum of m and n is from 2 to 25, and the ratio of m to n is from 1:5 to 2:1 with $C_8$–$C_{22}$ fatty alcohols.

9. The process of claim 1, wherein the sulfosuccinate is in the form of a salt.

10. The process of claim 9 wherein the salt is a sodium and/or ammonium salt.

11. The process of claim 9 wherein said flotation-effective quantity is from about 50 to about 2000 g/t crude ore.

12. The process of claim 1 wherein said flotation-effective quantity is from about 50 to about 2000 g/t crude ore.

* * * * *